US005129626A

United States Patent [19]

Koludzki

[11] Patent Number: 5,129,626

[45] Date of Patent: Jul. 14, 1992

[54] LOAD-CARRYING BOND DRIVING APPARATUS

[75] Inventor: Jean-Michel Koludzki, Pont sur Seine, France

[73] Assignee: Tractel, S.A., France

[21] Appl. No.: 529,360

[22] Filed: May 29, 1990

[30] Foreign Application Priority Data

May 29, 1989 [FR] France ..... 89 07015

[51] Int. Cl.[5] ..... B66D 1/02

[52] U.S. Cl. ..... 254/333

[58] Field of Search ..... 254/333, 334, 335, 336, 254/338, 382, 383

[56] References Cited

U.S. PATENT DOCUMENTS

| | | | |
|---|---|---|---|
| 219,237 | 9/1879 | Ennett | 254/333 X |
| 798,635 | 9/1905 | Stevenson, Jr. | 254/335 X |
| 2,684,166 | 7/1954 | De Jarnett | 254/333 X |
| 3,717,325 | 2/1973 | Peterson | 254/333 X |
| 3,729,173 | 4/1973 | Levardon | 254/333 |
| 3,750,970 | 8/1973 | Tremoulet, Jr. | 254/382 X |
| 4,005,852 | 2/1977 | Schmitmeyer | 254/333 X |
| 4,113,237 | 9/1978 | Derrwaldt | 254/333 X |
| 4,154,427 | 5/1979 | Hofmann | 254/223 X |
| 4,294,429 | 10/1981 | Desplats | 254/333 X |
| 4,953,829 | 9/1990 | Knaack et al. | 254/333 |

FOREIGN PATENT DOCUMENTS

| | | | |
|---|---|---|---|
| 0197356 | 4/1908 | Fed. Rep. of Germany | 254/334 |
| 2233269 | 1/1975 | France | 254/336 |
| 2632622 | 12/1989 | France . | |
| 2638802 | 5/1990 | France . | |
| 0176797 | 7/1989 | Japan | 254/334 |
| 0673274 | 2/1990 | Switzerland | 254/334 |
| 2061861 | 5/1981 | United Kingdom | 254/383 |

*Primary Examiner*—Daniel P. Stodola
*Assistant Examiner*—John P. Darling
*Attorney, Agent, or Firm*—William A. Drucker

[57] ABSTRACT

On the frame of the apparatus are pivoted the upper ends of two lateral levers of which the lower ends are respectively pivoted at the two ends of an intermediate horizontal lever, these levers defining three sides of a deformable parallelogram. Three rollers ar carried on a lever which rollers are adapted for clamping the strap circulating around the periphery of a pulley, while another lever carries a deflector roller which co-acts with the loaded strand of the strap for applying the rollers against the pulley. Besides the deflector roller are mounted two guide rollers which are urged by a spring. The loaded strand is guided between the deflector roller and one guide roller while the other strand, which is clamped between the guide rollers, is driven at a speed identical to the speed of the loaded strand but of opposite direction.

10 Claims, 3 Drawing Sheets

LOAD-CARRYING BOND DRIVING APPARATUS

BACKGROUND OF THE INVENTION

1. Field of the Invention

The invention relates to a drive pulley apparatus for driving a bond carrying a load at one of its ends and, more particularly, such an apparatus comprising a member for clamping the bond against the peripheral surface of the pulley actuated from a deflection of the load.

2. Brief Description of the Prior Art

Apparatus are known comprising a drive pulley device, driven manually or mechanically, which causes a bond carrying a load to travel over the periphery of this pulley without storing it, this bond generally having a round section, for example a cable. In such devices, adhesion of the bond to the peripheral surface of the pulley is provided by the clamping pressure, on the wound portion of the bond, of a pivoting means or a series of pivoting means such as rollers, this pressure being exerted in particular by the effect of a deflection of the load transmitted, by levers, to this or these means from a deflector means such as a roller.

Application of a device of this kind to driving flat flexible bonds, such as straps, raises special driving and guiding problems to which solutions have been brought for example by the French patents 1 121 039 and 1 389 136 as well as by the French Certificate of Addition applications 88 07611 and 88 14700.

SUMMARY OF THE INVENTION

The object of the present invention is to provide a solution to these problems which performs particularly well because of its simplicity and efficiency, particularly for providing guided tensioning of the slack strand of the bond on leaving the pulley, by combining guiding and driving of the two strands of the bond from a deflection of the load.

For this, the invention proposes using, as connection between the member clamping the bond on the periphery of the pulley and the deflector means cooperating with the load, a system of three levers articulated together at the ends, comprising two lateral levers, the free end of each of which pivots about a fixed point and an intermediate lever, which define a deformable parallelogram. The intermediate lever carries the load deflection means and one of the lateral levers carries the strand member applied to the periphery of the pulley. Advantageously, the intermediate lever also carries a member for guiding the strands of the cable.

With this construction, displacement of the lever system takes place under good conditions of alignment following a plane perpendicular to the axis of the drive pulley, for this system bears rotatably on two fixed points placed respectively at each of its ends. Furthermore, this construction makes is possible to associate the rotation of a deflector roller with guiding of the two strands of the bond by causing this pulley to cooperate with two other rollers mounted on the same lever, the three rollers being aligned close to each other so that rotation of the deflector roller causes that of the other two rollers by interpositioning of the two strands of the bond, respectively between each pair of rollers thus formed. Thus, both guiding and driving of the slack strand of the bond is obtained at a speed which is identical and opposite in direction to that of the strand to which the load is fixed. A pre-clamping spring exerts a longitudinal thrust on the intermediate lever in the direction applying the clamping member against the periphery of the pulley.

So that the deflector roller cooperates under good conditions with the other two rollers, the shafts of the latter are mounted in oblong openings whose largest dimension is oriented along the longitudinal axis of the lever carrying said rollers, the shaft of the end roller situated on the same side as the slack strand being urged by a spring in the direction of the axis of the deflector roller. Thus, cooperation of the three rollers for guiding and positive driving of the slack strand is ensured whatever the thickness or diameter of the bond, within the maximum limits tolerable by the mechanism thus constructed.

In order to facilitate insertion and passage of the bond in the drive mechanism, for bringing the apparatus into the operating condition before the load is applied, a disengagement lever is provided which is mounted for pivoting on a fixed shaft fast with the carrier frame of the apparatus and which acts on the intermediate lever. With the disengagement lever a translational movement can be applied to the intermediate lever in the direction opposite the direction of application of the pre-clamping spring which is applied thereto, so as to cancel out the action of the spring and disengage the clamping member from the peripheral surface of the pulley.

In one embodiment, the disengagement lever is articulated on the intermediate lever by the shaft of the guide roller situated on this lever on the same side as the slack strand of the bond. Thus, actuation of the disengagement lever results first of all in cancelling the action of the spring associated with this roller and so in a first phase disengagement of the rollers concerned from the strands of the bond which they drive and guide. In a second phase, this action results in neutralizing the pre-clamping spring acting on the intermediate lever, by applying to the latter a translational movement causing disengagement of the clamping spring from the peripheral surface of the pulley. By way of example, the clamping member may be in the form of a bogey articulated to the lateral lever and comprising several presser rollers.

So that the two strands of the cable are guided with the maximum safety, the intermediate lever comprises in its central portion a guide block in which are formed two orifices for passing the two strands of the cable therethrough, at least the orifice intended for the load carrying strand being oriented, in its length, in the direction of alignment of the apparatus with the load.

When the bond to be driven has a flat section, which forms a preferred application of the device of the invention, the peripheral profile of the clamping rollers is the counter profile of the peripheral profile of the drive pulley. The same goes for the peripheral profile of the intermediate guide roller with respect to the profile of the other two rollers with which it cooperates.

In a particular embodiment of the apparatus of the invention, the peripheral surface of the drive pulley is flat with two lateral shoulders between which the flat peripheral surface of the presser rollers is inserted, whereas the flat peripheral surface of the intermediate guide roller is inserted between the lateral shoulders of the flat peripheral surfaces of the two lateral guide rollers, one of which is formed by the deflector roller.

For a good understanding of the invention, an embodiment and a variant of the invention will be described hereafter, by way of example without any limitative character, with reference to the schematic accompanying drawings, in which:

DESCRIPTION OF THE PREFERRED EMBODIMENT

Figure 5:
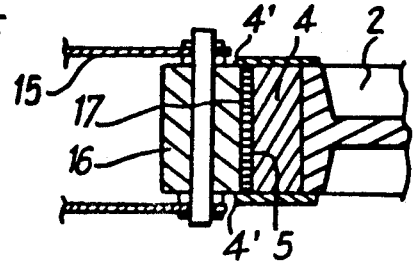
FIG. 5 is a partial vertical section through line V—V of FIG. 1.

In the drawings, the frame 1 of the apparatus of the invention has been shown equipped with a securing member A and carrying a drive pulley 2 mounted for rotation, under the action of drive means (not shown), about a horizontal transverse shaft 3. As can be seen in FIG. 5, the peripheral surface of pulley 2 is flat with two lateral shoulders 4' between which is inserted a strap 5 to the strand 6 of which the load (not shown) is attached, whereas the other strand 7 is not loaded.

On shaft 8 carried by frame 1 is articulated the end of a lateral lever 9 whose other end is articulated about a shaft 10 at one end of a horizontal intermediate lever 11. The other end of lever 11 is articulated about a shaft 12 at the lower end of a lateral lever 13 parallel to lever 9 and mounted for pivoting at its upper end about a shaft 14 carried by frame 1. The rotational shafts 8, 10, 12, 14 are disposed so that levers 9, 11 and 13 define a deformable parallelogram.

The lateral lever 9 carries a bogey 15 having three rollers 16, each of these rollers having a flat peripheral surface 17 (see FIG. 5) for engagement between shoulders 4' of the periphery of pulley 2 for clamping strap 5 against this pulley.

Figure 3:
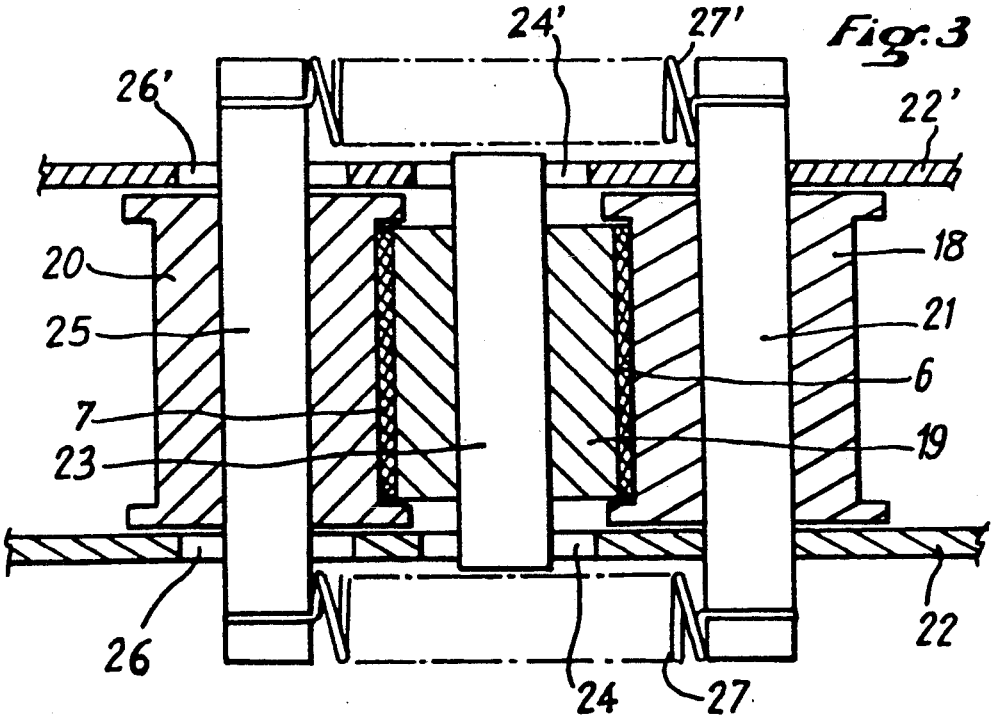
FIG. 3 is a horizontal cross-section through line III—III of FIG. 2.

The intermediate lever 11 carries three rollers aligned side by side comprising a deflector roller 18 and two guide rollers 19 and 20. As can be clearly seen in FIG. 3, the shaft 21 about which the deflector roller 18 may rotate is fixed in openings facing two flat bars 22, 22' forming the intermediate lever 11, the deflector roller 18 being disposed between these two bars. The shaft 23 of the intermediate guide roller 19 is mounted for freely moving in oblong openings 24, 24' oriented along the longitudinal axis of lever 11. On the other side of the deflector roller 18, with respect to the intermediate guide roller 19, is disposed the other guide roller 20 whose shaft 25 is mounted in oblong openings 26, 26' of bars 22, 22' oriented in the extension of openings 24, 24'. Traction springs 27, 27' connect shafts 21 and 25 together for urging the guide rollers 19, 20 towards the deflector roller 18. Between the deflector roller 18 and the intermediate guide roller 19 passes the loaded strand 6 of the strap 5 which is applied by roller 19 against the flat peripheral portion of roller 18. Similarly, the slack strand 7 of strap 5 is applied by roller 19 against the flat peripheral portion of roller 20.

Thus it can be seen that rotation of the deflector roller 18 causes that of the other two rollers 19, 20. The slack strand 7 of strap 5 being thus both guided and driven at a speed indentical, and in the opposite direction, to that of strand 6 to which the load is fixed. Because of the action of springs 27, 27', cooperation of the three rollers 18, 19, 20 is ensured whatever the thickness of strap 5, within the maximum limits tolerable by the mechanism.

The deflection action of the load, exerted on roller 18, is transmitted by the articulated lever system 9, 11, 13 to the clamping rollers 16. A pre-clamping spring 28, bearing in a cap 29 fixed to frame 1, exerts a longitudinal thrust on the intermediate lever 11 in a direction applying the clamping rollers 16 against the periphery of pulley 2.

Figure 1:
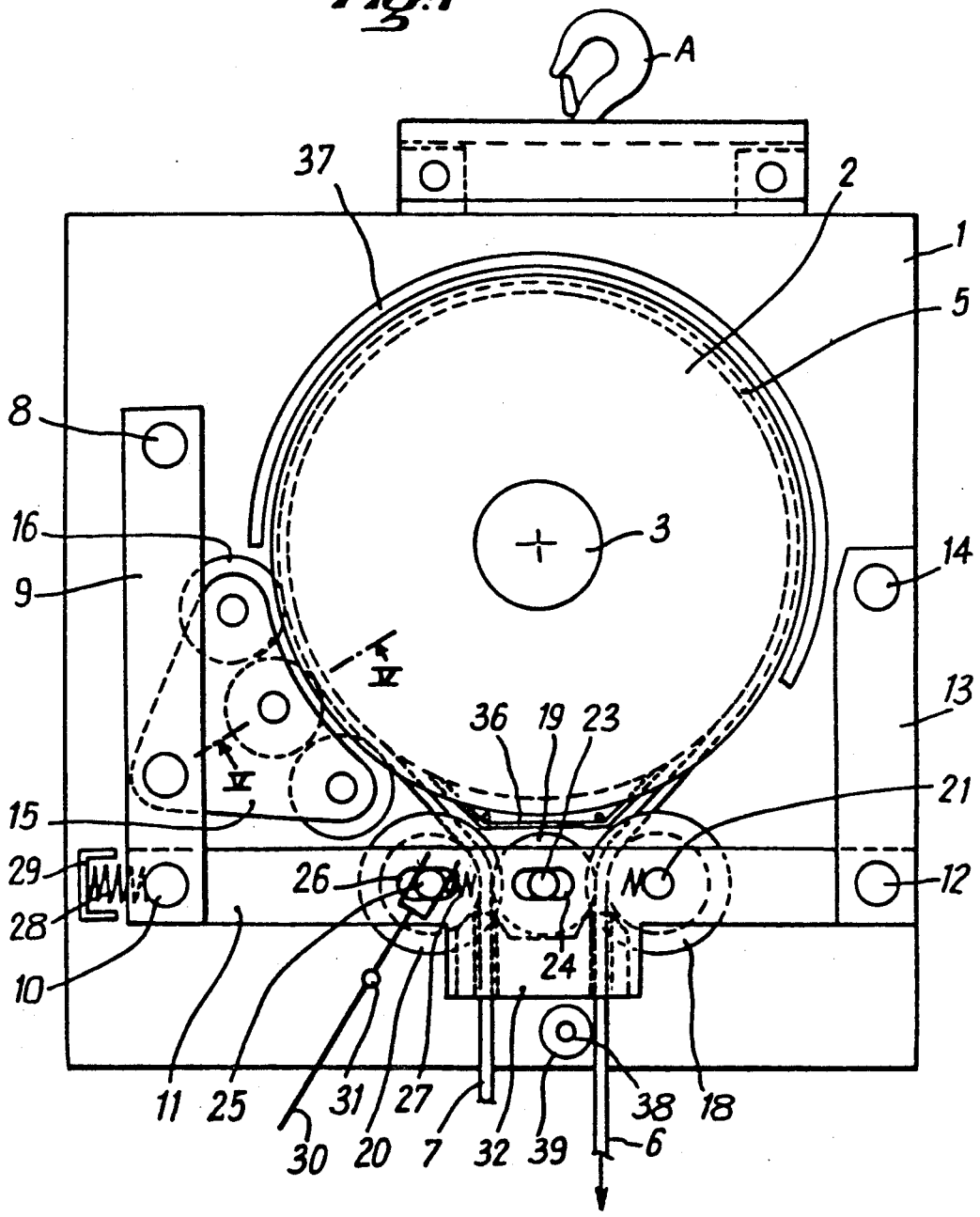
FIG. 1 is an elevational view of a device according to the invention for driving a strap.

In order to facilitate insertion and passage of strap 5 in the drive mechanism, for making the apparatus operative before the load is applied, a disengagement lever 30 is provided, an intermediate portion of which is articulated at 31 to frame 1. The end of lever 30 opposite its actuating protion is articulated to the intermediate lever 11 by the shaft 25 of guide roller 20. Thus, an action causing lever 30 to rotate in an anti-clockwise direction looking at FIG. 1 results first of all in neutralizing the action of springs 27, 27' by disengagement of rollers 20 and 19 from strands 6 and 7 of strap 5, then by neutralizing the pre-clamping spring 28 which causes disengagement of the clamping rollers 16 from the peripheral surface of pulley 2.

Figure 2:
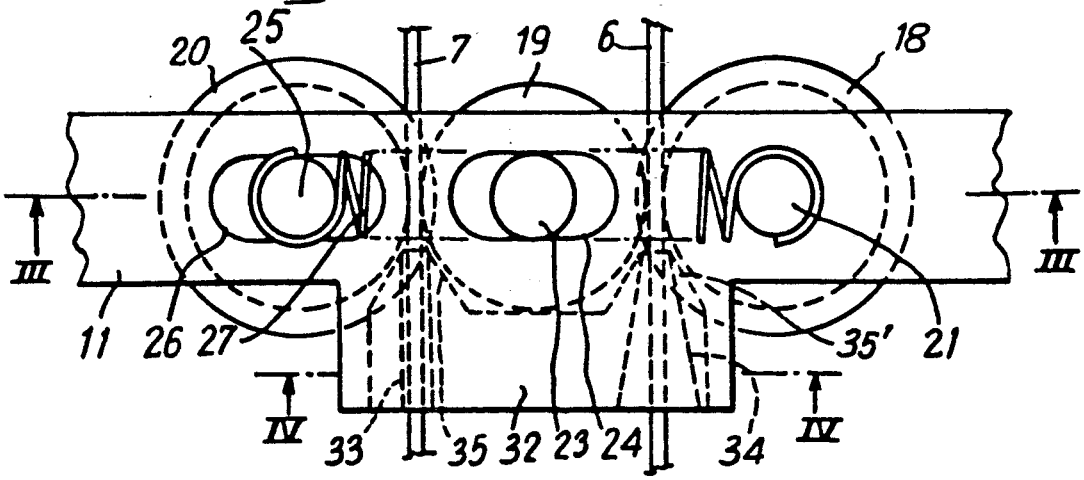
FIG. 2 is a detail view, on a larger scale, showing the roller guide system of the device of FIG. 1.
Figure 4:
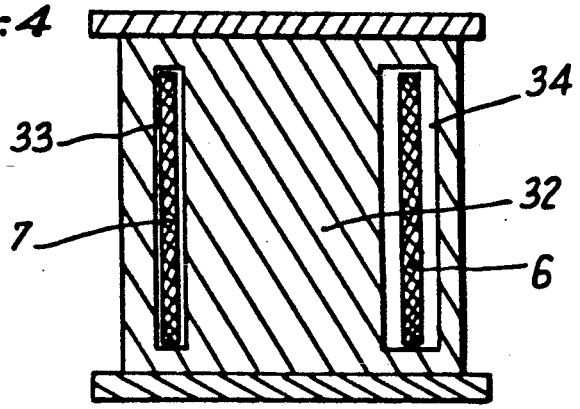
FIG. 4 is a horizontal cross-section through line IV—IV of FIG. 2.

In order to provide maximum guidance for the two strands of strap 5, the intermediate lever 11 in its central portion comprises a guide block 32 (see FIG. 4) in which are formed two orifices 33, 34 through which pass respectively the strands 7 and 6 of strap 5, these two orifices being oriented, in their length, in the direction of alignment of the apparatus with the load. As can be seen in FIG. 2, the guide block 32 has, towards the point at which each strand of strap 5 leaves the driving space between the two rollers cooperating with the strand, an extension 35, 35' which prevents deviation of said strand on leaving the rollers.

In the space between pulley 2 and the arcs of the facing rollers 18, 19, 20, is disposed a bent guide plate 36 which is fixed so that its two lateral faces have their ends very close to the peripheral surface of pulley 2. Thus, deviation of strands 6, 7 is avoided in their path between the winding arc of strap 5 over the pulley and guide rollers 18, 19, 20.

Another guide plate 37 is disposed at the periphery of pulley 2 and extends from the point where the loaded strand 6 of the strap leaves the deflector roller 18 as far as the point where it cooperates with the clamping rollers 16, thus ensuring guidance of strap 5 when the apparatus is made operative.

At the lower part of frame 1 is mounted a safety roller 39, for rotating freely about a shaft 38, which cooperates with the face of the loaded strand 6 opposite that cooperating with the deflector roller 18. The purpose of this safety roller is to neutralize the pendular movement which the loaded strand 6 of the strap is likely to take under the effect of the load and thus prevent lateral displacement being applied to the intermediate lever 11, in particular in the direction tending to suppress the pre-clamping. For the same purpose, the lower end of orifice 34 through which the loaded strand 6 passes has a bell shape.

Figure 6:
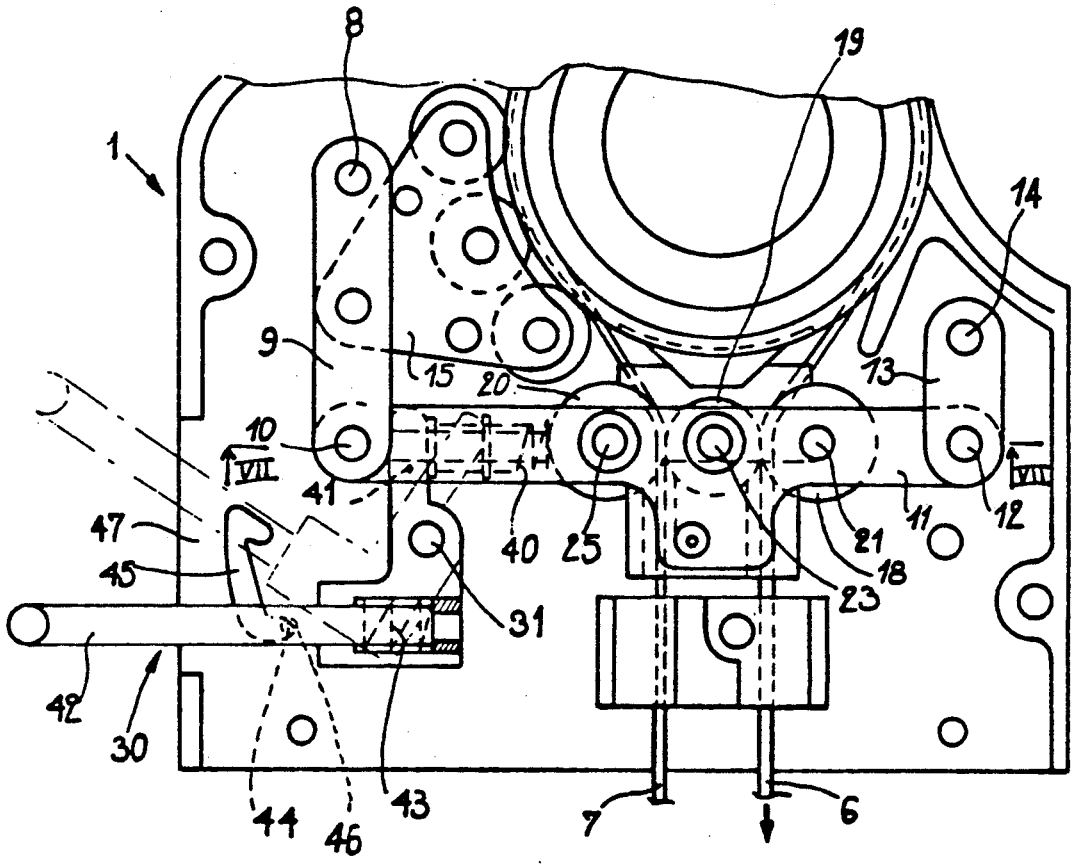
FIG. 6 is an elevational view of a variant of the device according to the present invention.
Figure 7:
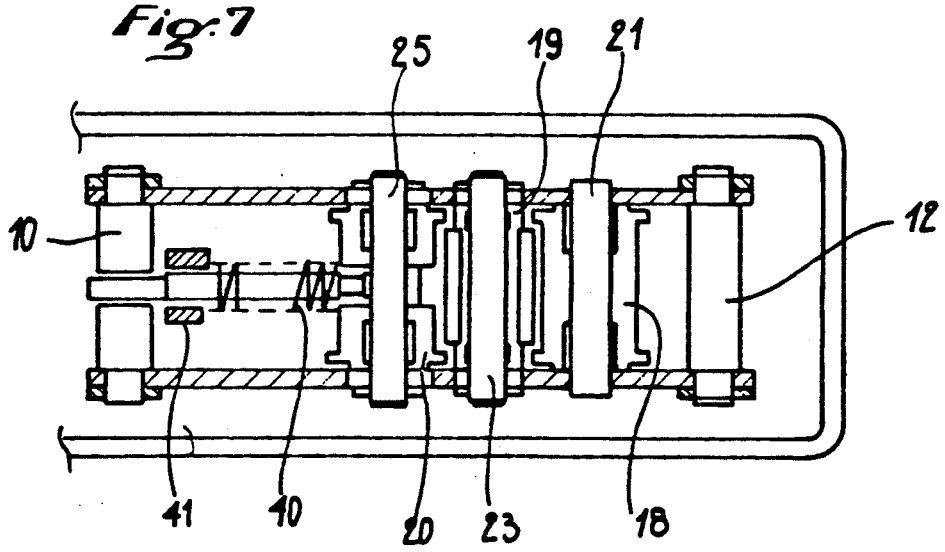
FIG. 7 is a horizontal cross-sectional view through line VII—VII of FIG. 6.

In FIGS. 6 and 7 a variant of the device of FIGS. 1 to 5 has been shown and, in these figures, the elements similar to those of the device of FIGS. 1 to 5 have been designated by the same reference numbers.

In these figures, a compression spring 40 engages by one of its ends the shaft 25 of roller 20 whereas its opposite end bears on the fork shaped end portion 41 of the disengagement lever 30. The operating rod 42 of the disengagement lever 30 is mounted on a spring 43 and carries a transverse shaft 44 designed for moving in a groove 45, formed in the case 47 of the apparatus, when lever 30 is operated. Groove 45 has a shape such that the shaft 44 is wedged in one end 46 of this groove when lever 30 is in its engaged position shown with dotted lines in FIG. 6.

It will be readily understood that, when lever 30 is operated from its disengaged position (shown with a continuous line in FIG. 6) to its engaged position (shown with a dotted line in FIG. 6), the thrust of the portion 41 of lever 30 on the spring 40 causes first of all the contact of the clamping member against the periphery of pulley 2 so as to provide clamping, then cooperation of rollers 18, 19, 20 for guiding and positively driving the slack strand 7. During operation of lever 30 to its disengaged position, the action of spring 40 is cancelled out which cancels out the cooperation of rollers 18, 19, 20 and the pre-clamping effect.

It will be understood that the above description has been given solely by way of example, without any limitative character, and that additions or constructional modifications could be made without departing from the scope of the invention defined by the accompanying claims.

What I claim is:

1. Device for driving a flexible bond carrying a load at one of its ends, which comprises:

(a) a drive pulley;

(b) a flexible bond running on a peripheral surface of said drive pulley, said flexible bond pressing a loaded strand and a slack strand;

(c) a system of three levers comprising a first lateral lever pivoted at one end to a carrier frame about a first fixed points, a second lateral lever pivoted at one end to said carrier frame about a second fixed point and an intermediate lever pivoted about a first pivot point to the first lateral lever and about a second pivot point to the second lateral lever, said first and second fixed points and said first and second pivot points constituting four apexes of a deformable parallelogram;

(d) a clamping member carried by said first lateral lever and pressing against the peripheral surface of the drive pulley to clamp said flexible bond;

(e) a deflector roller carried by the intermediate lever and co-acting with the loaded strand;

(f) a first guide roller carried by said intermediate lever and pressing, against said deflector roller, the loaded strand of the flexible bond;

(g) a second guide roller carried by said intermediate lever and having a shaft aligned with a shaft of the first guide roller and with an axis of the deflector roller, said second guide roller pressing said slack strand against said first guide roller;

(h) first elongate bearing surfaces provided axially in the intermediate lever and receiving the shaft of the first guide roller;

(i) second elongate bearing surfaces provided axially in the intermediate lever and receiving the shaft of the second guide roller; and (j) spring means carried by said intermediate lever and urging the second guide roller to press said second guide roller against said first guide roller and said first guide roller against said deflector roller, whereby action on the deflector roller by the loaded strand of the flexible bond results in a movement of the intermediate lever which causes the clamping member to press the flexible bond against the drive pulley, while rotation of the deflector roller causes rotation of the two guide rollers for both guiding and driving the slack strand of the flexible bond at a speed identical, and in the opposite direction, to the speed of the loaded strand.

2. Device according to claim 1, characterized by a pre-clamping spring which acts on the intermediate lever along the longitudinal axis thereof in the same direction as that of the deflection action applied by the load for exerting on the clamping member a permanent pre-clamping effect in the absence of the action of a load.

3. Device according to claim 2, which comprises a disengagement lever pivoting on a fixed point of the carrier frame and acting on the intermediate lever for imparting thereto a longitudinal displacement in the direction opposite that of the displacement imparted by the pre-clamping spring so as to cancel out the action of the pre-clamping spring and disengage the clamping member from the peripheral surface of the pulley.

4. Device according to claim 3, wherein the disengagement lever acts on the intermediate lever at the level of the shaft of an end guide roller situated on the slack strand side of the bond, so that actuation of the disengagement lever firstly cancels out the action of the spring acting on said end guide roller thus disengaging the rollers from each other then secondly displaces the intermediate lever against the action of the pre-clamping spring by disengagement of the clamping member and the peripheral surface of the drive pulley.

5. Device according to claim 2, wherein the pre-clamping spring bears at one end on a fixed point of the carrier frame whereas its other end acts on the intermediate lever.

6. Device according to claim 2, which comprises a guide block fast with the central portion of the intermediate lever and covering, on the side opposite that of the drive pulley, the space defined by the peripheral arcs of the three rollers carried by this intermediate lever, two passages being formed in said guide block for the strands of the bond and having respectively one orifice situated at the point at which each of the strands leaves the rollers guiding the strands at least the passage intended for the carrier strand being oriented in its length along the direction of alignment with the load of the carrier frame.

7. Device according to claim 2, characterized by a safety roller carried at a lower portion of the frame below the deflector roller and close to the loaded strand said safety roller cooperating with the face of this strand opposite the other face of the strand applied on the deflector roller for neutralizing an action tending to displace the intermediate lever against the effect of the pre-clamping spring following a defect of alignment between the device and the load.

8. Device according to claim 1, wherein the spring urging the shaft of an end is engaged by the end portion of the disengagement lever for providing, when this lever passes from its disengaged position to its engaged position, firstly a pre-clamping effect then secondly-cooperation of the rollers.

9. Device according to claim 8, wherein a rod of the disengagement lever is mounted on a spring and has a shaft guided in a groove of a case of the apparatus when said lever passes from its disengaged position to its engaged position and conversely, said shaft being wedged in one end of the groove when the lever is in its engaged position.

10. Device according to claim 1, which comprises a guide mask covering the arc of the drive pulley not covered by the winding of the bond, said mask being fixed to the carrier frame and having two lateral ends situated in extreme proximity to the peripheral surface of the pulley so as to deviate the strand of the bond leaving the pulley out of the circular path which the pulley, by its movement, tends to impart thereto.

* * * * *